US005932853A

United States Patent [19]

Friedli et al.

[11] Patent Number: 5,932,853

[45] Date of Patent: Aug. 3, 1999

[54] IDENTIFICATION SYSTEM FOR A LIFT INSTALLATION

[75] Inventors: Paul Friedli, Remetschwil; Kilian Schuster, Ballwil; Karl F. Schneeberger, Nsingen, all of Switzerland

[73] Assignee: Inventio AG, Hergiswil, Switzerland

[21] Appl. No.: 08/929,040

[22] Filed: Sep. 15, 1997

[30] Foreign Application Priority Data

Sep. 27, 1996 [EP] European Pat. Off. ..... 810641

[51] Int. Cl.[6] ..... B66B 1/34

[52] U.S. Cl. ..... 187/392; 187/384

[58] Field of Search ..... 187/384, 392

[56] References Cited

U.S. PATENT DOCUMENTS 3,828,335 8/1974 Salmet ..... 340/258
4,979,594 12/1990 Begle et al. ..... 187/121
5,400,722 3/1995 Moses et al. ..... 109/2
5,615,622 4/1997 Moses et al. ..... 109/2
5,677,666 10/1997 Stallbohm ..... 340/426

*Primary Examiner*—Robert E. Nappi
*Attorney, Agent, or Firm*—Schweltzer Corman Gross & Bondell LLP

[57] ABSTRACT

An identification system for a lift installation in which a lift user carries with him an information transmitter. The information transmitter communicates individual data, for example the weight of the lift user, to a recognition device, which files the data in a data bank. Lift users without information transmitters, so-called unauthorized travellers, are detected with the aid of a load-measuring device. A comparator compares the weight in a lift cage with the weight identified by means of the information transmitter to verify the identity of the lift user as the user to whom the information transmitter was assigned. In the case of agreement, a release signal issued to a lift control, which dispatches or otherwise permits operation of the lift cage.

5 Claims, 1 Drawing Sheet

IDENTIFICATION SYSTEM FOR A LIFT INSTALLATION

The invention relates to an identification system for a lift installation, with information transmitters carried by lift users and/or objects and at least one recognition device for reception of data from the information transmitter.

BACKGROUND OF THE INVENTION

An identification system for a lift installation has become known from European patent application EP 0 699 617, in which an information transmitter carried by a lift user transmits data to a recognition device of the lift installation. These data can comprise items of information for the identification of the lift user and items of information about the destination story desired by the lift user. Communication between the information transmitter and the recognition device is effected by means of, for example, radio frequencies. If the data of the lift user, which are verified by a processing unit, leads to a carry-out or exit authorization at the desired destination story, the desired destination story is communicated to the lift control. The destination call lift control allocates the desired destination story to a specific lift cage and indicates the allocation to the lift user by means of an indicating device.

A disadvantage of known equipment is that unidentified lift users, so-called unauthorized travellers, who occupy a lift cage together with authorized lift users, cannot be recognized, which can lead to overload in the lift cage. Also, security on stories intended for specific persons can not guaranteed, because unauthorized persons can obtain access to such reserved stories.

It is accordingly the purpose of the present invention to provide a solution to such problems. The present invention avoids the disadvantages of known equipment and creates an identification system in which lift users and/or objects intended for transport can be recognized.

The advantages achieved by the invention are realized through a manner of function of the destination call lift control which cannot be disturbed by unidentified lift users and/or objects. Security on the stories is increased by the obligatory identification of persons and/or articles.

DESCRIPTION OF THE DRAWINGS

The invention is explained more closely in the following detailed description by reference to the annexed drawings which illustrate an embodiment of the invention and in which.

DETAILED DESCRIPTION OF THE INVENTION

Figure 1:
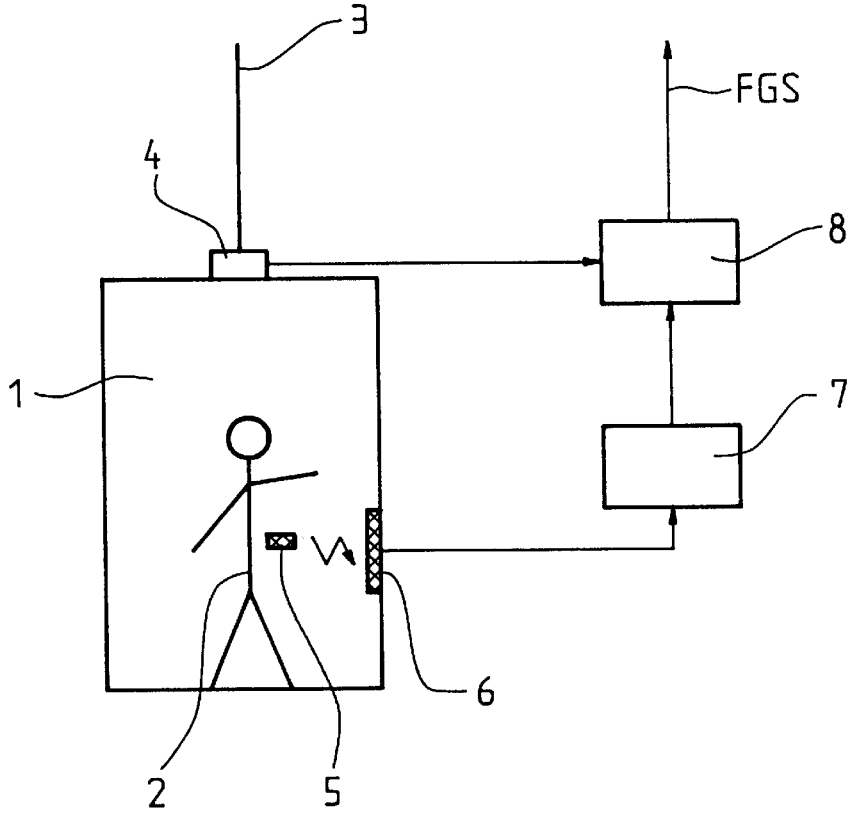
FIG. 1 is a schematic illustration of an identification system in accordance with the invention.

A lift cage, in which a lift user 2 is located, is designated by 1 in FIG. 1. The lift cage 1 is suspended at one end of a cable 3, which is guided over a drive pulley driven by a drive (not shown); a counterweight (not shown) is arranged at the other end of the cable 3. A load-measuring device 4, which measures the weight of the lift cage 1 and of the lift user 2, is arranged between the cable end and the lift cage 1. As the weight of the cage is known, the weight of the users can be determined. The load-measuring device 4 can alternatively be integrated into the floor of the lift cage 1 as known from the state of the art. In this latter case the weight of the lift users and objects located in the lift cage is measured directly. A further variant for measuring the cage load may consist of measuring the displacement of the lift cage 1, which is mounted on springs, relative to an upper yoke of the support frame. A sensor arranged at the upper yoke measures the spacing, which changes in the case of load, of the cage ceiling from the yoke and generates a signal corresponding to the load. The load measurement can also be effected within a defined space in front of the lift cage 1, through which the users must pass to enter the lift cage.

The lift user 2 carries with him for identification an information transmitter 5. Objects such as, for example, shopping trolleys, luggage carts, hospital beds, containers, etc., can also be equipped with an information transmitter. As used herein, such objects may also be considered "lift users". The information transmitter 5 has the form of, for example, a credit card, a wristwatch, a key fob, a button or a signet ring and can be embodied as an active element with a transmitter, receiver, memory and battery, or as a passive element fed by way of an electromagnetic field. The information transmitter 5 is dormant outside the region of the lift and is awakened by way of an electromagnetic field radiated by at least one recognition device 6. The recognition device 6 can be arranged, for example, in the lift cage 1 as shown in FIG. 1 and/or on the story. In the case of a recognition device 6 arranged on the story the identification takes place before the occupation or loading of the lift cage 1.

For identification, the information transmitter 5 transmits data to the recognition device 6. These data comprise items of information about, for example, the desired destination story, the identification code of the lift user 2, individual features of the lift user such as, for example, weight, body size, appearance, etc., or items of information about the object to be transported. This data is received by a data bank 7. The weight of the lift user 2 or of the object to be transported can also be filed in the data bank and used in the identification. The data bank is also adaptable to individual weight changes in the course of use of the lift. The weight data bank can also be constructed from data developed in the course of use of the lift, in that the weight of the lift users 2 or objects is detected and stored.

Before closing of the cage door the identified weight of the lift users and/or objects is passed on to a comparator 8, which compares the weight which is detected by the load measurement device 4 in the lift cage 1 with the identified weight. If the actual weight in the lift cage 1 is greater than the identified weight by a specific amount the comparator 8 does not generate a release signal FGS. The lift cage 1 remains stationary, wherein a corresponding optical and/or acoustic signal is produced in or in front of the lift cage 1. If the measured weight agrees with the identified weight, the release signal FGS is passed on to the lift control, which dispatches the lift cage 1.

Figure 2:
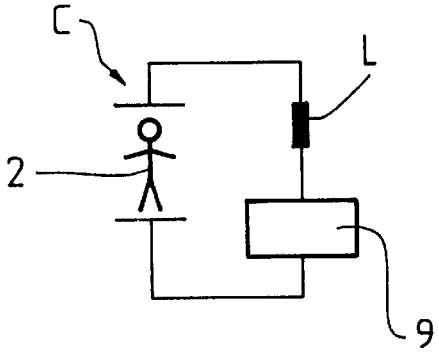
FIG. 2 illustrates a first modification thereof.

FIG. 2 shows a variant of the invention for detection of features of the lift user 2 by means of electromagnetic waves. A resonant circuit consisting of an inductance L and a capacitor C can be used instead of the load-measuring device 4 shown in FIG. 1. The resonance frequency is measured by means of a measuring device 9. The lift user 2 influences the dielectric constant of the capacitor C, whereby the capacity of the capacitor C is changed. The LC ratio determines the resonance frequency of the resonant circuit. The resonant circuit is thus tuned to a changed frequency according to the respective body mass (or weight) of the lift user. The measuring device 9 measures the resonance frequency change due to the body mass, generates a corresponding mass signal and passes this on to the comparator S. If the measured mass agrees with the identified mass, the release signal FGS is passed on to the lift control, which dispatches the lift cage 1.

Figure 3:
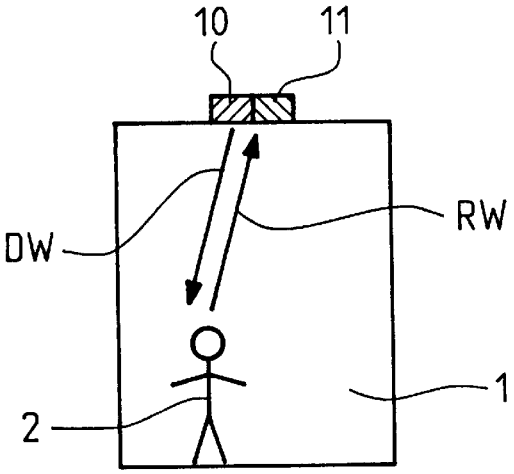
FIG. 3 illustrates a second modification thereof.

FIG. 3 shows a further variant for detection of the lift user 2 intended for transport by means of pressure waves, wherein the principle of echo sounding is employed. A transmitter 10 irradiates the lift cage 1 with pressure waves DW. A receiver 11 picks up an image of the lift user 2 in the lift cage 1 by virtue of the absorbed or the reflected waves RW and passes on the image to the comparator 8. If the measured image agrees with the identified image, the release signal FGS is passed on to the lift control, which dispatches the lift cage 1. The absorption characteristic can also be registered on the standing area of the lift user 2. For that purpose the floor is penetrated by surface waves and the floor loading detected on the basis of the reflection pattern.

We claim:

1. An identification system for a lift installation comprising an information transmitter carried by a lift user, at least one recognition device for reception of reference data from the information transmitter, and means associated with the lift installation for activating the information transmitter when in proximity to the lift installation without intervention by the lift user, detecting data associated with the lift user and for comparison with the reference data of the information transmitter for generating a signal reflecting the results of said comparison.

2. The identification system according to claim 1 wherein said data detecting means comprises a load-measuring device to detect the weight of the lift user, said reference data received by said recognition device included a reference weight of said lift user, and said comparison means comprises means for comparing the detected weight with the reference weight received by the recognition device, whereby a signal for release for a lift cage of the lift installation is generated upon agreement between the detected weight and the reference weight.

3. The identification system according to claim 1 wherein said data detecting means comprises an L-C resonant circuit, the resonant frequency of which is able to be influenced by the body mass of a lift user intended for transport and a frequency measuring device for measuring the resonance frequency and converting said measured resonance frequency to a body mass value, said comparison means comprising means for comparing the body mass value with reference body mass data received by said recognition device, whereby a signal for release for a lift cage of the lift installation is generated upon agreement between the body mass value and the reference body mass.

4. An identification system according to claim 1, wherein said data detecting means comprises a transmitter for radiating pressure waves onto a lift user and a receiver for measuring the pressure waves which are reflected by the lift user in the form of an image, said comparison means comprising means for comparing the image detected by the detector with a reference image received by the recognition device, whereby a signal for release for a lift cage of the lift installation is generated upon agreement between the detected image and the reference image.

5. An identification system according to any of claims 1 to 4 further comprising a data bank which is coupled to the comparator, the data bank having a weight table of lift users adaptable to individual weight changes of lift users occurring in the course of use of the lift.

* * * * *